United States Patent [19]

Patterson

[11] 4,121,307

[45] Oct. 24, 1978

[54] POSITIVE FLOW SWIMMING POOL GUTTER

[75] Inventor: James A. Patterson, Columbus, Ohio

[73] Assignee: Patterson Enterprises, Columbus, Ohio

[21] Appl. No.: 765,534

[22] Filed: Feb. 4, 1977

Related U.S. Application Data

[60] Continuation-in-part of Ser. No. 592,950, Jul. 3, 1975, and Ser. No. 653,512, Jan. 29, 1976, abandoned, which is a division of Ser. No. 592,950.

[51] Int. Cl.[2] ..... E04H 3/20

[52] U.S. Cl. ..... 4/172.17

[58] Field of Search ..... 4/172, 172.15, 172.16, 4/172.17, 172.18, 172.19, 172.21; 210/169; 138/105; 61/22 A, 25, 28; 137/409, 426, 433, 451

[56] References Cited

U.S. PATENT DOCUMENTS

| | | | |
|---|---|---|---|
| 3,319,264 | 5/1967 | Scarano | 4/172.17 |
| 3,596,296 | 8/1971 | Gertz | 4/172.17 |
| 3,616,468 | 11/1971 | Takacs | 4/172.15 |
| 3,990,167 | 11/1976 | Whitten | 4/172.17 X |

*Primary Examiner*—Richard E. Aegerter
*Assistant Examiner*—Stuart S. Levy
*Attorney, Agent, or Firm*—Wood, Herron & Evans

[57] ABSTRACT

A pool having an open gutter around its perimeter including a back wall, a bottom and an inner wall. A suction pipe extending around the perimeter of the pool at the bottom of the gutter connected to the suction side of a pump provides for positive withdrawal of water from the gutter.

1 Claim, 3 Drawing Figures

POSITIVE FLOW SWIMMING POOL GUTTER

BACKGROUND OF THE INVENTION

This application is a continuation-in-part of U.S. Ser. No. 592,950, filed July 3, 1975, and of U.S. Ser. No. 653,512 now abandoned, filed Jan. 29, 1976, which is a division of Ser. No. 592,950.

The invention is directed to swimming pools generally of the type wherein the swimming pool tank is surrounded by a gutter at the top of the walls forming the tank. This type of pool is particularly desirable for large municipal type installations, particularly where competitive swimming will be involved. The pool is particularly desirable for competitive swimming because of the use of the gutter in the coping by which the gutter is formed. The gutter receives surges of water generated by the competitive swimming and permits the surges of water to be conveyed to the filter system without splash back into the pool. Such pools are regarded as "fast" pools by swimmers because the absence of splash back causes less resistance to the movement of the swimmer through the pool.

Such pools have been provided with skimmers, that is, openings in the inner gutter wall which permit flow of pool water into the gutter without having to raise the water level to overflow the gutters. The skimmers provide a continuous flow of water into the gutter in times when the pool is in a quiescent state. The objectives to be attained by the skimmers are to maintain flow of water from the pool through the skimmers into the gutter to keep the pool clean of debris and scum, to keep the gutters supplied with water which flows to the filter to thereby maintain the gutters themselves clean, and to permit the gutters themselves to provide capacity to receive the surge of water without splash back or flooding during periods of high activity.

In conventional gravity flow gutters, there is a tendency for the gutters to be unable to remove surges of water under conditions of great activity in the pool thereby resulting in flooding of the gutter. A flooded pool gutter is an undesirable condition since the flooded pool gutter has no capacity to accommodate surges. Moreover, on flooding of the pool gutter, there is wash back of debris and scum collected in the gutter into the pool.

Further, in conventional gravity flow gutters there is a tendency for the water in that section of the gutter remote from the gutter outlet to flow more slowly than the water adjacent the gutter outlet and hence the water in the gutter in the remote portions of the pool tends to remain somewhat stagnant.

BRIEF DESCRIPTION OF THE INVENTION

The objective of the present invention has been to provide an improved gutter which provides for positive flow of water from the gutter to the pool filter to continuously and positively drain the gutter about the perimeter of the pool.

The objective of the invention is achieved by providing a gutter extending around the perimeter of the pool having a suction pipe located in the bottom of the gutter and extending around the perimeter of the pool, the interior of the suction pipe being connected to a low pressure side of a pump and whose high pressure side is connected to the pool filter.

Thus, the gutter by operation of the pump is continuously drained of water through the gutter suction pipe. In quiescent periods, where there is more or less continuous and even flow of water into the gutter through the skimmer, the positive flow gutter provides for removal of water in the gutter at all points around the perimeter of the pool, thus eliminating any stagnation of water. On the other hand, when activity in the pool increases to the extent that waves are continuously rolling over the inner gutter wall, the positive flow gutter removes these excessive quantities of water, thereby providing assurance of sufficient gutter capacity to accommodate the wave action.

The present invention is particulary useful with the skimmer structure disclosed in the above-referenced applications. The skimmer structure disclosed therein provides automatic monitoring and control of water level in the gutter so as to be sure there is a continuous flow in the gutter to keep the gutter clean while at the same time blocking off flow through the skimmer openings during active periods, thereby tending to prevent the flooding of the gutters by virtue of the combined surges over the wall of the gutter and flow through the skimmers. The skimmer structure thus provides assurance that the gutter will be continuously supplied with water. This is important to this invention in order to avoid sucking air into the pump. Alternatively, the positive flow gutter of the present invention could be used in a pool having no skimmers wherein the level of the pool was kept sufficiently high that water continuously overflowed the gutter wall to maintain a continuous supply of water into the gutter.

Another objective of the invention has been to provide a gutter and conduit system which avoids the necessity of the water in the gutter travelling from remote locations via the gutter to the filter, but rather effects the removal of the water directly from the gutter from locations spaced around the gutter.

These several objectives and features of the invention will become more readily apparent from the following detailed description taken in conjunction with the accompanying drawings.

DETAILED DESCRIPTION OF THE INVENTION

Figure 1:
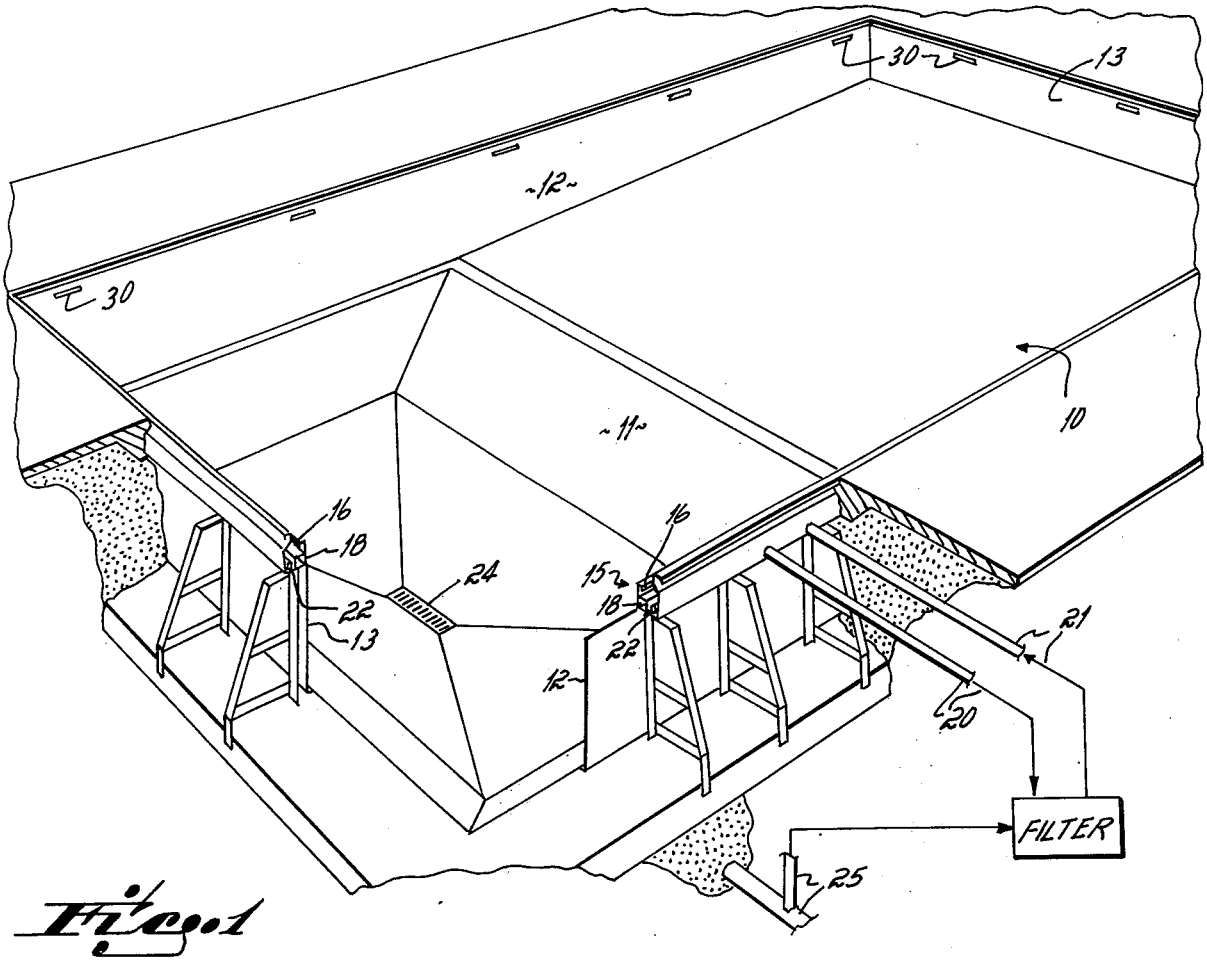
FIG. 1 is a diagrammatic perspective view of a pool incorporating the present invention.

Referring to FIG. 1, there is shown a swimming pool 10 having a bottom wall 11, side walls 12 and end walls 13. Mounted on the top of the side and end walls is a coping 15 creating a gutter 16. At the gutter-forming coping is a wall-formed conduit 18 around the pool, the conduit 18 having outlet openings spaced around the periphery of the pool for delivering filtered water to the pool. The gutter shown in FIG. 1 is disclosed in my U.S. Pat. application Ser. No. 691,446 filed June 1, 1976. The gutter 16 and the conduit 18 are connected to a filter by pipes 20 and 21, respectively. The pipe 21 delivers water under pressure to the conduit 18. The pipe 20 is connected to a suction pipe 22 disposed in the bottom of the conduit 16 and receives water by suction through the filter pump. Water may also be removed from the pool by a main drain 24 and delivered to the pool through pipe 25. Spaced around the perimeter of the pool as, for example, every 50 feet, are skimmers 30 which may be of the type described in copending applications Ser. No. 592,950, filed July 3, 1975, and Ser. No. 653,512, filed Jan. 29, 1976.

Figure 2:
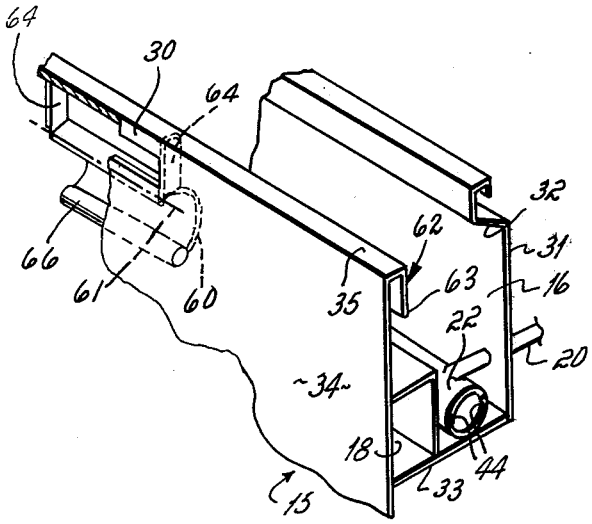
FIG. 2 is an enlarged cross-sectional view of the embodiment illustrated in FIG. 1.

As shown in FIG. 2, the gutter coping 15 has a back wall 31 which has an inner inclined portion 32 which causes waves splashed onto it to be driven down into the gutter. The coping 15 has a bottom plate 33 and an inner wall or lip 34. The inner wall 34 terminates in a generally U-shaped section 35 at its upper end.

The suction pipe 22 is disposed in the lower portion of gutter 16 and is connected by means of pipe 20 communicating with the interior of the pipe 22 through the vertical wall 31 to the low pressure side of a pump in the filter system. The suction pipe 22 extends about the perimeter of the pool and communicates with the gutter 16 through a plurality of holes 44 in the wall thereof spaced along its length.

The size of the suction pipe 22 and the holes 44 may vary depending on the size of the gutter and the desired rate of flow of water through the pipe. Conveniently, the suction pipe may be of 2 to 12 inches in diameter with the holes 44 being 5/16 to ½ inch in diameter.

In the embodment shown in FIG. 2, the gutter 16 is completely open although a grate or screen may be conveniently employed across the top to trap debris to prevent possible plugging of the suction pipe holes. In this embodiment, a continuous flow of water either through skimmers 30 or over the lip 35 of the gutter conduit maintains a level of water in the gutter 16 above the holes 44 in the suction pipe 22 to prevent the pump from sucking air. The suction pipe 22 functions to maintain a continuous and positive flow of water from the gutter conduit to the pool filter. The use of suction evacuation of water provides assurance of sufficient gutter capacity to accommodate even the greatest conditions of activity in the pool while avoiding flooding of the gutter. Further, it avoids the necessity of water travelling from remote locations via the gutter to the filter, but rather effects the removal of the water directly from the gutter from locations spaced around the gutter.

As indicated above, the skimmers 30 may be of the type described in copending applications Ser. No. 592,950, filed July 3, 1975, and Ser. No. 653,512, filed Jan. 29, 1976. Those skimmers are provided with an automatic float control which is operative to permit water to flow through the skimmer opening 30 into the gutter so as to maintain water in the gutter above the passageways 44 in the suction pipe 22. However, when surges of water overflow the inner wall of the gutter and tend to fill the gutter, the float is raised by the increased level of water in the gutter and closed so as to prevent further flow of water into the gutter through the skimmer opening until the suction pipe draws the level of water down to its normal operating level.

Figure 3:
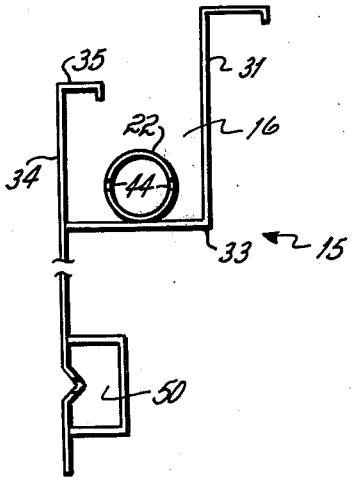
FIG. 3 is a cross-sectional view of an alternative embodiment of the invention.

While the float control may be of any suitable design, some configurations being shown in the copending applications, in FIG. 3 the float is shown as consisting of a curved plate 60 which is connected by a hinge 61 to the inner wall 34 of the gutter. Above the plate the skimmer hole or opening 30 is formed in the inner wall through which water from the pool can flow into the gutter. The plate 60 extends across an inverted U-shaped portion 62 of the inner wall 34 and is engageable with the flange 63 so as to seat there and close off the flow from the opening 30 into the gutter. Vertical plates 64 are secured in the U-shaped portion 62 to form a closed chamber above the hinged plate 60. A plastic tube 66 is secured to the plate 60, the tube 66 extending well down into the gutter below the skimmer opening 30 but above the suction tube 22. The tube, being hollow, forms a float which is raised when the level of the water in the gutter is too high. The raising of the float swings the curved plate 60 upwardly into engagement with the flange 63, thereby functioning as a valve to close off the skimmer opening 30.

In operation, the water from the pool flows into the gutter continuously through the skimmer openings 30 or over the top of the inner gutter wall in the case of surges from pool activity. In any event, the float 66 automatically operates to provide assurance that at all times the passageways in the tube 22 are covered with water.

When so covered with water, a suction pipe withdrawing water from the tube 22 will substantially uniformly draw water out of the gutter at all locations around the perimeter of the pool. Thus, the combination of the automatic float-controlled skimmer maintaining a proper level of water in the gutter and the suction pipe around the perimeter of the pool provides for continuous evacuation of the water from all parts of the gutter without cavitation of the pump and without gravity flow.

In FIG. 3, there is shown a further embodiment of the invention wherein the inlet water conduit 50 is disposed substantially below the gutter conduit 16. Pool constructions of this type are disclosed in my U.S. Pat. No. 3,890,230. In the gutter conduit shown in FIG. 3, the suction pipe 22 is disposed at the bottom of the conduit 16 and provides for positive flow of water from the gutter to the pool filter internally of the pipe 22 in the manner described above.

Thus having described the invention what is claimed is:

1. In a swimming pool having generally vertical walls and a filter system adjacent said pool, a nonflooding perimeter gutter system for returning water from said pool to said filter system comprising, an open gutter section located adjacent the top of said vertical walls and extending around the perimeter of said pool and having an inner wall, a back wall and a bottom wall, said upper gutter section being operative to accommodate sudden water surges over said inner wall, a suction pipe in said gutter adjacent said bottom wall extending around the perimeter of said pool and having passageways connecting said pipe with said gutter, said passageways consisting of a plurality of holes in the wall thereof spaced along its length, said suction pipe forming a closed lower gutter section around the perimeter of the pool adjacent said upper gutter section, said lower gutter section, at all times during operation, being completely filled with water, a plurality of skimmer openings spaced around the perimeter of said pool and located in said inner gutter wall adjacent the top of said inner gutter wall, means independently and automatically closing each said opening, said closing means including a float located in said gutter and associated with each said opening, said float being located well below said skimmer openings but above said lower gutter section, and effecting the closing of said openings when the level of water in said gutter, lifting said float, rises to a level well below said opening and well above the level of said passageways in said second gutter section, said skimmer openings and said closing means continuously supplying water from said pool to said upper gutter section at locations spaced around the perimeter of said pool to maintain a constant flow of water to said lower gutter section above said passageways during both periods of quiescence and periods of greater pool activity, and suction means connected to said lower gutter section for positively withdrawing water therefrom and directing it to said filter system, thereby continuously withdrawing water simultaneously from all portions of said perimeter gutter through said plural passageways in order to maintain a constant flow of water in said gutters with a constant removal of water from said gutters, without relying on gravity flow to said filter system, thereby creating substantially uniform surge capacity around the perimeter of said pool, the maintenance of water in said upper section preventing air from flowing into said lower gutter section and into said pump.

* * * * *

UNITED STATES PATENT AND TRADEMARK OFFICE

CERTIFICATE OF CORRECTION

PATENT NO. : 4,121,307

DATED : October 24, 1978

INVENTOR(S) : James A. Patterson

It is certified that error appears in the above-identified patent and that said Letters Patent are hereby corrected as shown below:

Col. 4, Line 19, "pipe" should be -- pump --

Col. 4, Line 44, after "open," insert -- upper --

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*